US006513273B2

(12) United States Patent
da Silveira

(10) Patent No.: US 6,513,273 B2
(45) Date of Patent: Feb. 4, 2003

(54) SAFETY DEVICE FOR A AUTOLOADING OR AUTOMATIC PISTOL

(75) Inventor: Nilton da Silveira, Port Alegre (BR)

(73) Assignee: Forjas Taurus S.A. (BR)

( * ) Notice: Subject to any disclaimer, the term of this patent is extended or adjusted under 35 U.S.C. 154(b) by 0 days.

(21) Appl. No.: 09/881,262

(22) Filed: Jun. 15, 2001

(65) Prior Publication Data

US 2002/0020099 A1 Feb. 21, 2002

(30) Foreign Application Priority Data

Aug. 15, 2000 (BR) ..... 0003687

(51) Int. Cl.[7] ..... F41A 17/00; F41C 7/00

(52) U.S. Cl. ..... 42/70.08; 42/70.08; 42/70.11; 42/16; 89/142; 89/148

(58) Field of Search ..... 42/70.08, 70.11, 42/16; 89/148, 185, 142

(56) References Cited

U.S. PATENT DOCUMENTS

| | | | | | |
|---|---|---|---|---|---|
| 3,397,473 | A | * | 8/1968 | Browning | 42/70.08 |
| 3,462,869 | A | * | 8/1969 | Wallace | 42/70.08 |
| 3,553,877 | A | * | 1/1971 | Welch et al. | 42/70.08 |
| 3,882,622 | A | * | 5/1975 | Perlotto | 42/70.08 |
| 4,726,136 | A | * | 2/1988 | Dornaus et al. | 42/70.08 |
| 5,426,882 | A | * | 6/1995 | Dornaus | |
| 5,467,550 | A | * | 11/1995 | Mumbleau | 42/70.11 |
| 6,141,896 | A | * | 11/2000 | Oberst | 42/70.11 |
| 6,240,670 | B1 | * | 6/2001 | Findlay | 42/70.08 |
| 6,256,917 | B1 | * | 7/2001 | Findlay | 42/70.11 |
| 6,347,638 | B1 | * | 2/2002 | Doiron | 89/148 |

FOREIGN PATENT DOCUMENTS

| | | | | |
|---|---|---|---|---|
| EP | 0 343 115 | A2 | * 11/1989 | 42/70.08 |

* cited by examiner

*Primary Examiner*—Michael J. Carone
*Assistant Examiner*—Lulit Semunegus

(57) ABSTRACT

A safety device for a automatic pistol, which safety device for a pistol is comprised of a safety pin (1) housed in a recessed hole (16) of the slide (15), which safety pin can assume a first position in which the gun is unlocked, and a second position in which the gun is locked, composed of a cylindrical head (2) provided with a notch (9) made according to a chord of the respective circumference externally bounded by a convex surface (3) in the central part of which there is a hole (4) from the head (2) of which a cylindrical body (5) provided with a helical groove (6) adjacent the head (2) projects inwardly, two positioning slots (7) and a flat recess (8) parallel to the axis thereof that extends from practically half of its length as far as its end opposite the head (2). When said safety pin is switched to "locked" position, the head (2) thereof projects from the side surface of the slide (15), the ball-spring assembly (12, 13) cooperates with another positioning slot (7), said flat recess (8) is in a vertical position perpendicular to the axis of the firing pin (28), thus interfering with the lower notch (29) of said firing pin (the (28), and said notch (9) of the head (2) of the safety pin (1) is perpendicular to-the guide (26) of the frame (31), and said head (2) starts interfering with the housing (24) resulting from the concave faces of the boss (23) and the notch (25) of the guide (26), thus preventing the gun to be triggered.

11 Claims, 8 Drawing Sheets

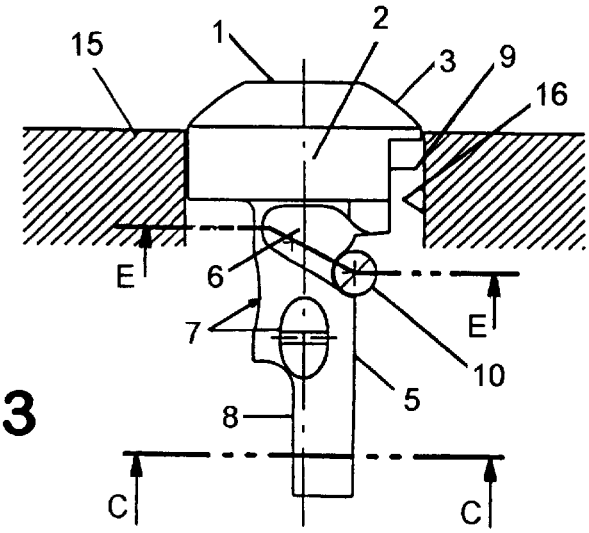
FIG. 3
FIG. 9
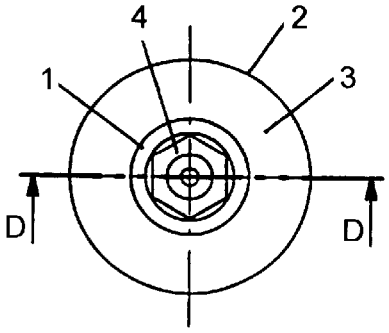
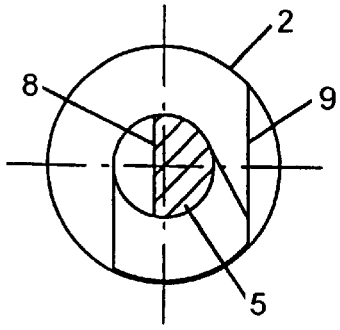
FIG. 5
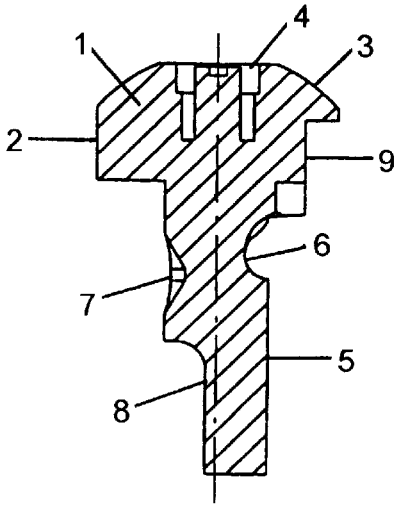
FIG. 10
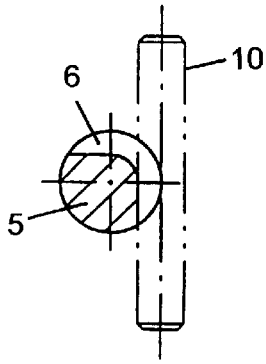
FIG. 7

SAFETY DEVICE FOR A AUTOLOADING OR AUTOMATIC PISTOL

BACKGROUND OF THE INVENTION

The present invention is directed to a safety device to be incorporated into automatic pistols, which device can be actuated only by means of a special key.

Safety devices for fire guns, both revolvers and pistols, are well known. In the case of revolvers, the safety devices disclosed in Brazilian patent applications PI 9604462-7, PI 9604463-2, and PI 9702959-4 are known. In the case of automatic pistols, safety devices, such as the one disclosed in Brazilian patent application PI 9803506-1 that relates to a safety in the back of the grip, are known.

SUMMARY OF THE INVENTION

In general, in the case of safety devices for both revolvers and pistols, the device itself is assembled on the grip or frame of the gun.

The invention introduces a radically different solution exclusively related to automatic pistols wherein the safety device is incorporated into the slide thereof.

The safety device object of the present invention is characterized in that it comprises a safety pin in a recessed hole disposed on the right side of the slide, where the holding notches thereof are situated. Said pin is actuated only by means of a special key that can rotate same by 90° in the clockwise or counter-clockwise direction.

When the safety device is actuated by means of the special key by rotating same in the clockwise direction, it is impossible for anyone who is not holding said key to shoot the gun, either accidentally in the case of children or when someone gets hold of same improperly.

When the pin is rotated by 90° in the clockwise direction, it prevents the firing pin from moving and consequently the trigger that directly actuates same. Simultaneously, the slide is locked in the closed position, thus assuring the complete deactivation of the gun. This safety activated mode is further distinguished by the rounded head of the safety pin that becomes slightly salient in relation to the side face of the slide, which is perceivable both through the touch and visually.

The safety device of the present invention is lodged in the slide and basically comprised of a safety pin having a cylindrical head of a larger diameter, externally bounded by a curved surface, in the center of which a hole suitably shaped for the insertion of the tip of the special actuation key is located. From the inner face of the head and opposed to the curved surface thereof the body of the safety pin itself is projected, which pin is elongated and provided with a generically cylindrical shape whose diameter is lower than that of the head.

Said elongated body of the safety pin is provided with a helical groove adjacent the head, followed by two positioning slots, and in the remaining part it is provided with a flat recess that extends as far as its end. The cylindrical part of a higher diameter that constitutes the head is also provided with a flat notch following a chord of the respective circumference. The plan of said notch is parallel and diametrically opposed to the flat recess of the pin end.

A fastening bolt attached to the slide that cooperates with the helical groove determines the axial recoil or advance hi movement of the safety pin when rotated. The 90° limit of said rotation is dictated by the shape and dimensions of the helical groove of the safety pin.

A single ball-spring assembly that is also housed in the slide cooperates with each one of the two positioning slots of the safety pin, in a hole perpendicular to the axis of said safety pin.

When assembling the safety device of the present invention, the ball-spring assembly is housed in the respective hole before the safety pin is inserted into the slide, which is placed and kept in its position by means of the fastening bolt which is, in turn, ultimately attached by means of a plate screwed to the lower part of the slide.

After the assemblage and already in the operating mode at a first position that is reached by being rotated by 90° in the counter-clockwise direction using the special key, the safety pin recedes toward the interior of the slide and its head is paired with the right face of same, thus characterizing the unlocked condition of the gun. The flat recess of the inner end of the safety pin is positioned facing upward and parallel to the axis of the firing pin, and therefore it does not interfere with the corresponding notch located in the lower part of the firing pin, thus letting same free to move when actuated by the trigger.

In this position of the safety pin, the notch of its head is also parallel to the frame guides, thus allowing the slide to move in relation thereto.

In a second position attained when the safety pin is rotated by 90° in the clockwise direction by using the special key, it is slightly displaced out of its lodging until the external curved face is slightly projected in relation to the right face of the slide. The total safety state of the gun is thus characterized, either visually or through the touch.

In that position, the flat recess of the inner end of said safety pin is perpendicular to the axis of the firing pin and therefore the semi-cylindrical part of said end interferes with the corresponding notch of said firing pin, thus preventing same from moving. Also in this position the flat recess of the safety pin head is perpendicular to the frame guide, while the lower cylindrical part of said head is housed in the appropriate notch of that guide, with which a disarming ramp boss cooperates. In that position of the safety pin, the slide is locked in relation to the frame. In both limiting positions of the safety pin, any accidental displacement is prevented by the interference of the ball-spring assembly with the respective positioning slots of said bolt.

The shape of the safety pin head hole prevents the eventual use of any type of screw driver or another tool, to rotate said pin to unlock the pistol. Similarly, the convexity and polishing of the outer face of the head that arises slightly from the surface of the slide when in the locked position will prevent the use of pliers or the like to unlock same.

BRIEF DESCRIPTION OF THE DRAWINGS

The safety device of the present invention will be better understood in the light of the description below taken with reference to the attached figures that illustrate a preferential and not limiting form of accomplishment, in which:

FIG. 3 is a top view of the safety pin shown in the locked position;

FIG. 5 is a cut view of section CC' of the safety pin in the position of FIG. 3;

FIG. 7 represents section EE' of FIG. 3, related to the fastening bolt;

FIG. 9 is a top view of the safety pin head, showing the hole wherein the safety key is to be inserted;

FIG. 10 represents a cut of the safety pin of FIG. 3, according to plan DD' of FIG. 9;

DETAILED DESCRIPTION OF PREFERRED EMBODIMENTS

Figure 1:
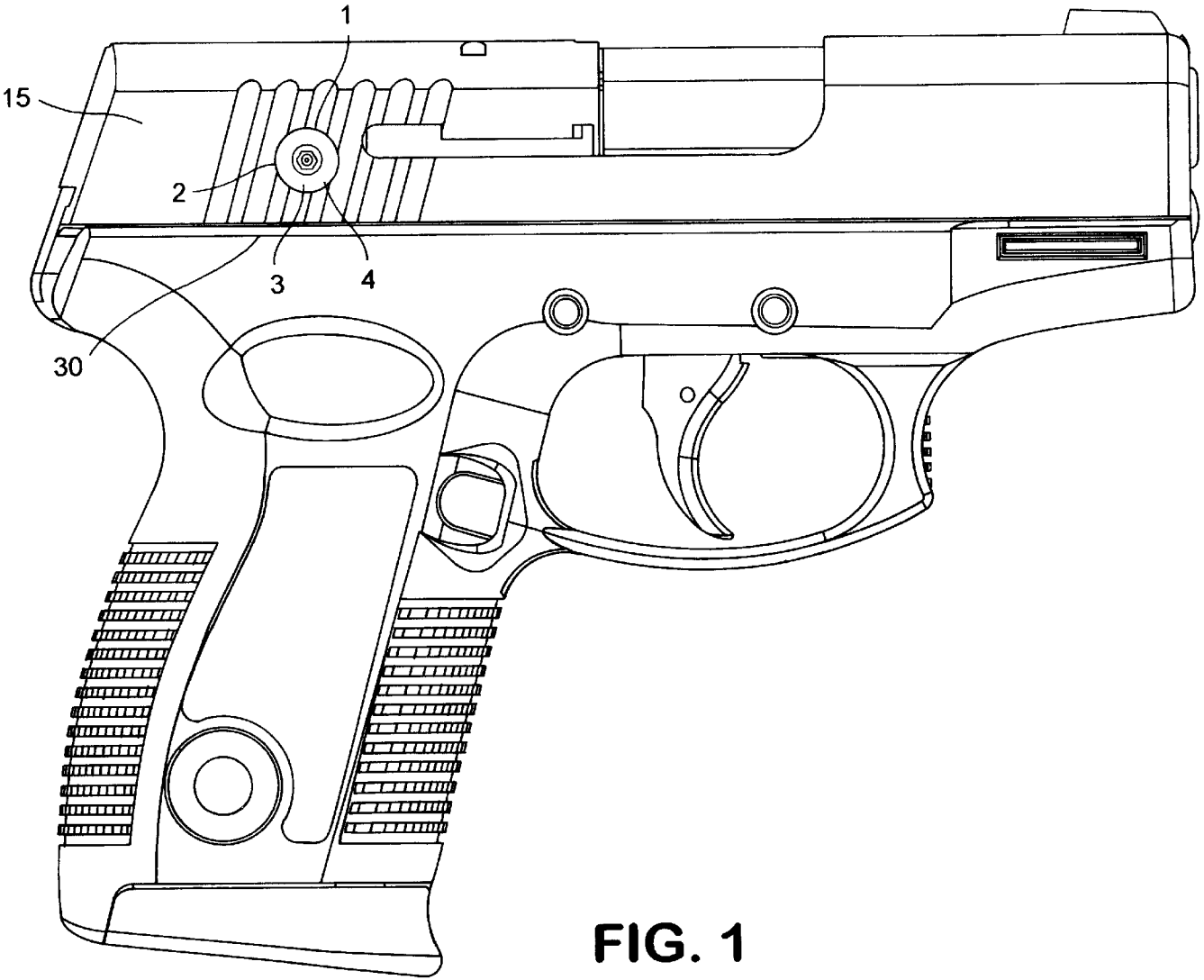
FIG. 1 is a right side view of the pistol, showing the positioning of the safety pin head of the safety device in the slide.
Figure 2:
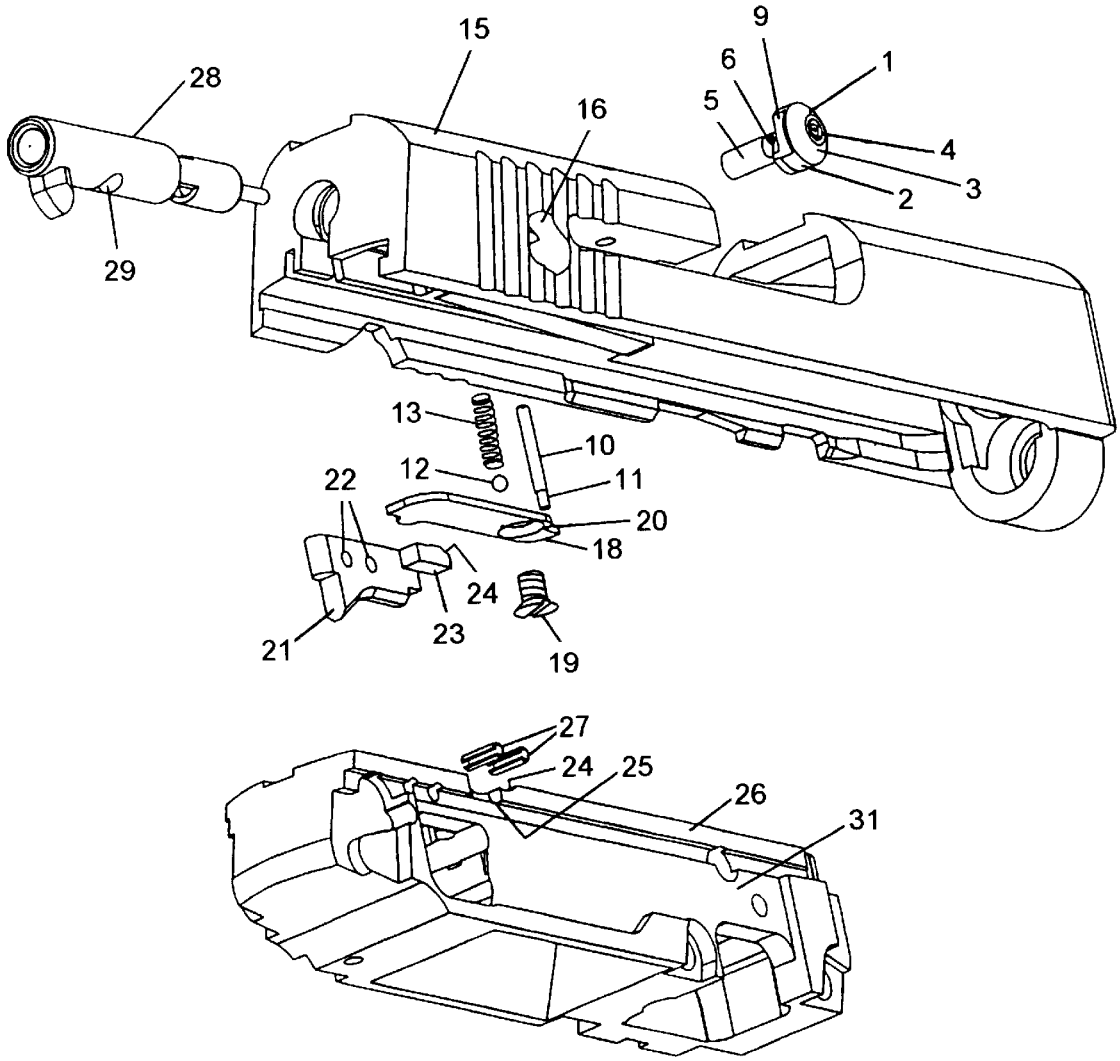
FIG. 2 is an exploded view of the main components of the safety device, relating same with the slide and the metallic reinforcement of the frame, both disassembled.
Figure 4:
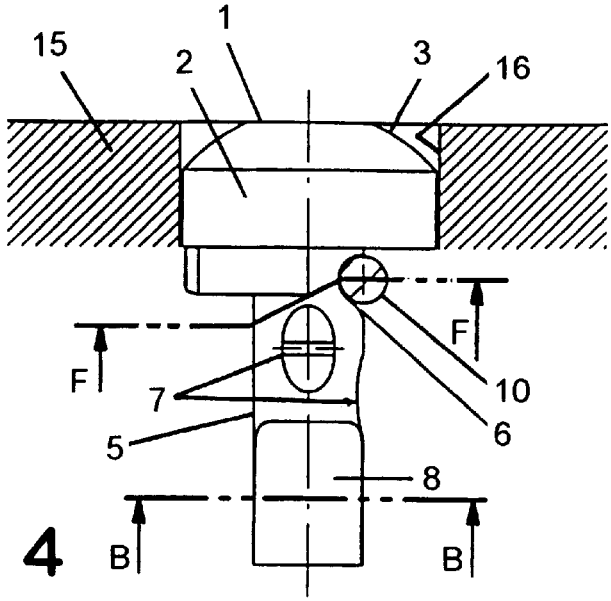
FIG. 4 is a top view of the safety pin shown in the unlocked position.
Figure 6:
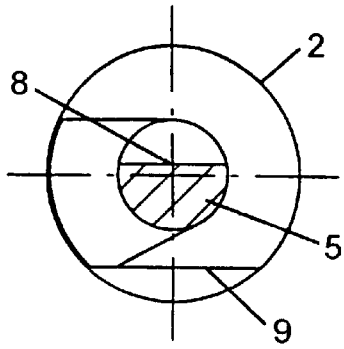
FIG. 6 is a cut view of section BB' of the safety pin in the position of FIG. 4.
Figure 8:
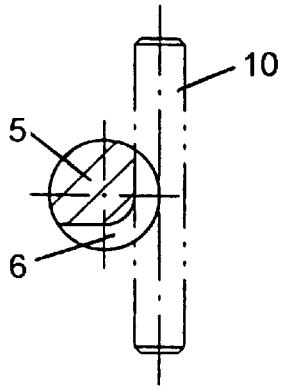
FIG. 8 represents section FF' of FIG. 4, related to the fastening bolt.
Figure 11:
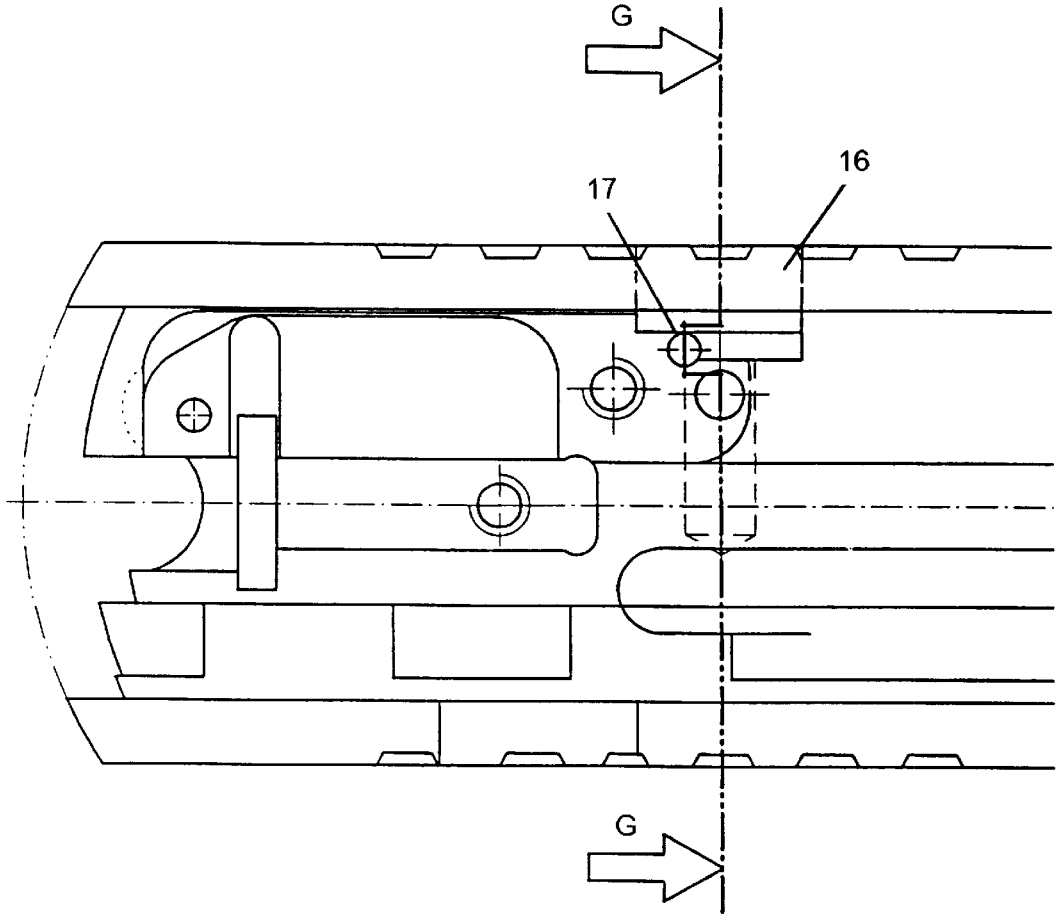
FIG. 11 is a partial bottom view of the back of the slide of FIG. 2.

In accordance with the accompanying drawings, the safety device object of the present patent is comprised of a safety pin (1) housed in a recessed hole (16), perpendicular to the right face of the slide (15). The safety pin (1) comprises a cylindrical head (2) externally bounded by a convex surface (3), in the central part of which there is a hole (4) into which the special key (32) is to be inserted. A cylindrical body (5) of a lower diameter projected inwardly from head (2), which body is provided, adjacent the head (2), with a helical groove (6) and then two positioning slots (7). Moreover, the bolt (5) is provided with a flat recess (8) parallel to its axis that extends from practically the half of its length as far as its end opposite the head (2). In the cylindrical side of the head (2) of the safety pin (1) there is also a notch (9) made according to a chord of the respective circumference the plan of which is parallel to the that of the recess (8).

After the spring (13) and the ball (12) are inserted in the corresponding hole (14) of the slide (15), the safety pin (1) is carefully inserted into the respective housing which is comprised of the recessed hole (16) transversally disposed in the same slide and breechblock which are an integral part of the slide forging. Then the fastening bolt (10) is inserted into the corresponding hole (17) of the slide (15). The fastening bolt (10) will then cooperate with the helical groove (6) of the safety pin (1), thus defining its movement and simultaneously keeping same inserted in the recessed hole (16).

The safety device assembly described above remains permanently assembled in the slide (15) after the plate (18) located in the lower part thereof is attached thereto by means of the screw (19). In this plate (18) there is a small notch (20) that cooperates with the recessed tip (11) of the fastening bolt (10) in order to keep same in the respective hole (17).

The safety pin (1) can be rotated by 90° in the clockwise or counter-clockwise direction, exclusively by means of the special key (32) the tip of which is compatible with the shape of the hole (4) of the head (2) of said bolt. The safety pin (1) can assume two positions inside the recessed hole (16) of the slide (15).

Figure 12A:
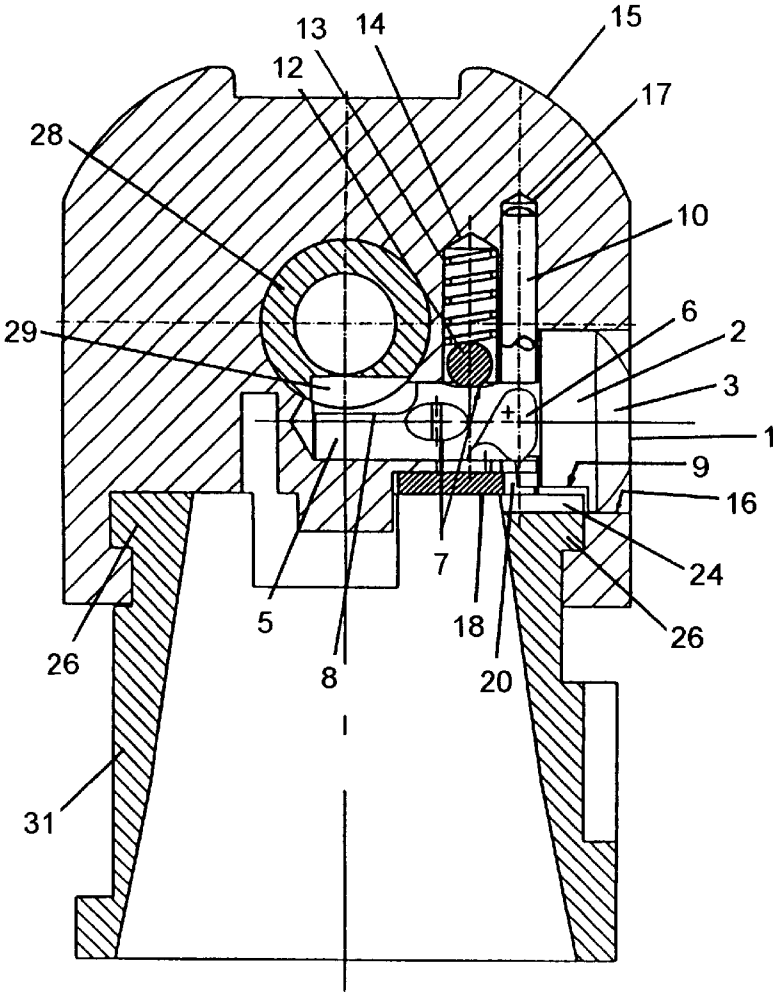
FIG. 12 is a representation of a vertical cut of the slide, breechblock and the metallic reinforcement of the frame passing across the axis of the safety pin in accordance with the section through line GG' in the bottom view of FIG. 11. The safety pin lies in the unlocked gun position, schematically illustrated in the corresponding right side view.
Figure 12B:
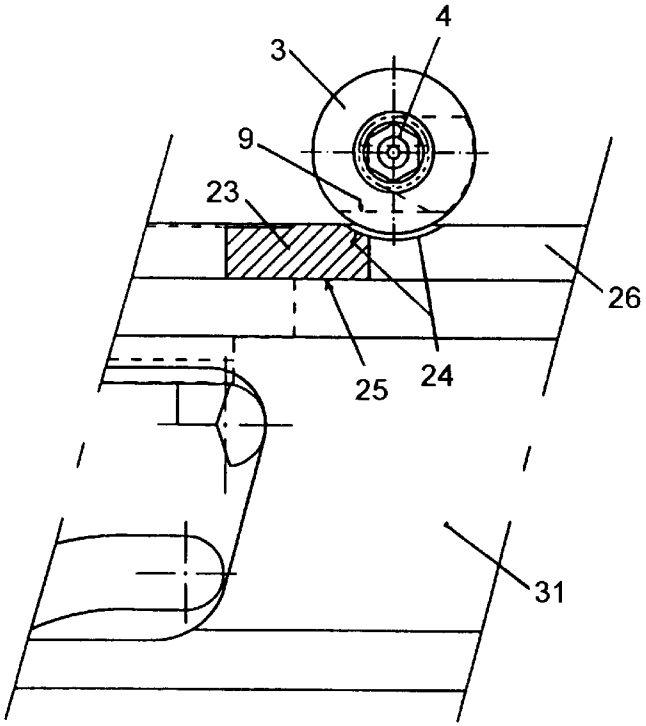

The first position that corresponds to the unlocked state of the safety device shown in FIG. 12 is reached when the safety pin (1) is rotated 90° in the counter-clockwise direction by means of the special key (32). During the rotation, the fastening bolt (10) cooperates with the helical groove (6) of the safety pin (1), urging same to penetrate even more in the recessed housing (16) of the slide (15). The head (2) of the safety pin (1) is paired with the right side surface of the slide (15). In that position (see FIG. 12), the flat recess (8) of the safety pin is in the horizontal position in parallel with the axis of the firing pin (28) without interfering with the lower notch (29) thereof and releasing same so that it can be actuated by the trigger. Similarly, the notch (9) of the head (2) of the safety pin is parallel to the guide (26) of the frame (31) releasing said head (2) from its interference with the housing (24). This is composed of the concave faces of the boss (23) and the notch (25) of the guide (26), when both cooperate as the disarming cover (21) in the frame (31) is inserted and attached thereto by two bolts (27) in the respective holes (22).

Therefore, the slide under those conditions can slide freely in the guides (26) of the frame (31).

Figure 13A:
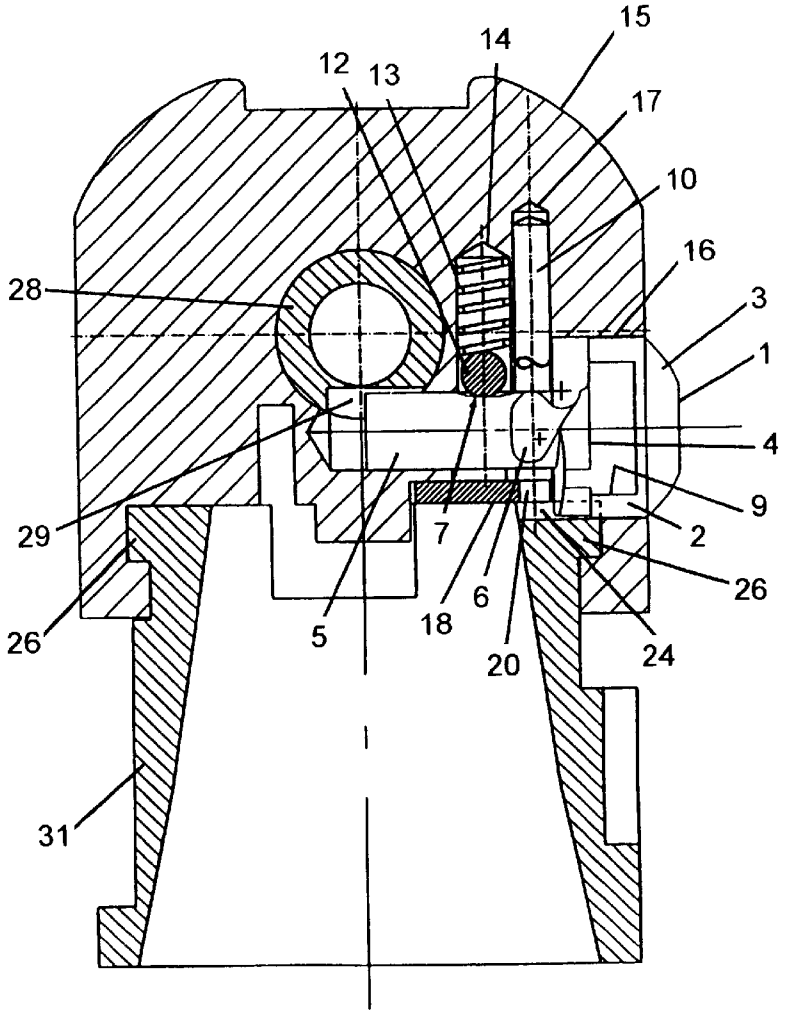
FIG. 13 is a representation similar to that of FIG. 12, but showing the safety pin in the locked position, schematically illustrated in the corresponding right side view.
Figure 13B:
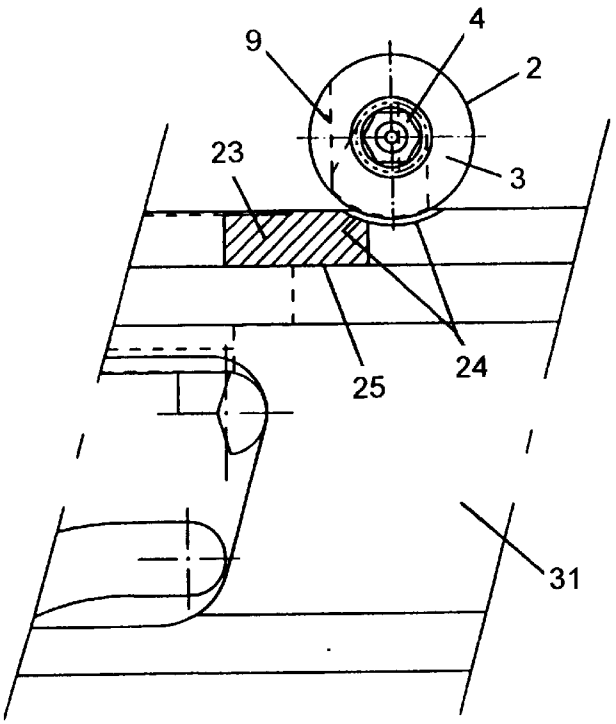
Figure 14B:
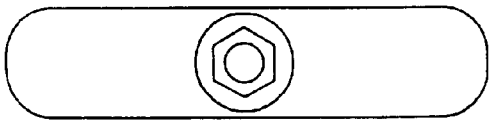
FIG. 14 represents the special key and the shape of the tip thereof.
Figure 14A:
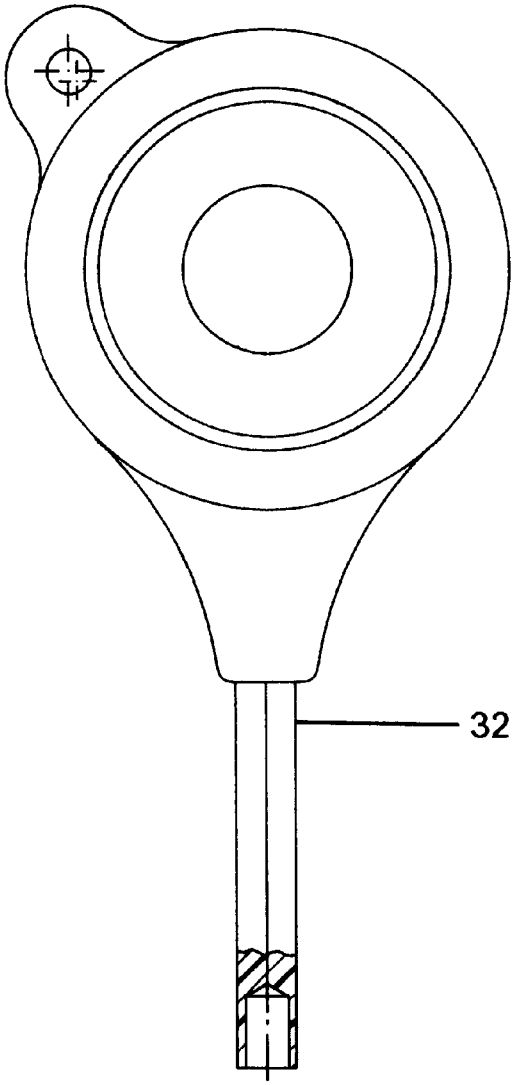

The second position that corresponds to the locked state of the safety device is reached (see FIG. 13) when the safety pin (1), by means of the special key (32), is rotated 90° in the clockwise direction.

Thus, the fastening bolt (10) cooperates with the helical groove (6) of the safety pin (1), resulting in a slight projection of its curved surface (3) in relation to the side face of the slide (15). In that position, the flat recess (8) is perpendicular to the axis of the firing pin (28) axis and therefore the rest of the semi-cylindrical tip (5) of the safety pin (1) is housed in the notch (29) of the firing pin, thus preventing its actuation by the trigger. Simultaneously, the notch (9) of the head (2) of the safety pin (1) is also perpendicular to the direction the slide is moved to, and the cylindrical part of said head (2) is fit into the housing (24) resulting from the cooperation of the boss (23) of the disarming ramp (21) when inserted into the notch (25) of the guide (26) of the frame (31).

Any movement of the slide (15) in the locked position of the safety pin (1) is thus prevented, what can be noticed either visually or through the touch, in view of the projection of the head (2) in relation to the side of the slide (15).

The limits of the rotations of the safety pin (1) are established by the extension of the helical groove (6) cooperating with the fastening bolt (10). Such limits are additionally improved by the click of the ball (12) when it is fit compressed by the spring (13), in the positioning slots (7) of the body (5) of the said bolt.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A safety device for a automatic pistol, which comprises: a safety pin (1) housed in a recessed hole (16) of a slide (15), which safety pin can assume a first position in which the gun is unlocked, and a second position in which the gun is locked, composed of a cylindrical head (2) provided with a notch (9) made according to a chord of the respective circumference externally bounded by a convex surface (3); a hole (4) in the central part of said convex surface (3); a cylindrical body (5) projecting inwardly from the head (2) and provided with a helical groove (6) adjacent the head (2); said safety pin further including two positioning slots (7) and a flat recess (8) parallel to the axis thereof that extends from practically half of its length as far as its end opposite the head (2).

2. The device according to claim 1, where in the plain of said notch (9) of the cylindrical head (2) of the safety pin (1) is parallel to the plain of the recess (8) and diametrically opposed thereto.

3. The device according to claim 1, wherein a fastening bolt (10) is housed in a corresponding hole (17) of the slide (15) and cooperates with said helical groove (6) of the safety pin (1).

4. The device according to claim 3 wherein said fastening bolt (10) is provided with a lower recessed tip (11) that cooperates with a notch (20) provided in a fastening plate (18) attached to the lower part of the slide by means of a screw (19).

5. The device according to claim 1, wherein the positioning slots (7) cooperate with a ball-spring assembly (12,13) housed in a respective hole (14) of the slide (15).

6. The device according to claim 1 wherein the hole (4) of the head (2) of the safety pin (1) has a shape that corresponds only to the shape of the tip of the actuating key (32).

7. The device according to claim 1, wherein, in said first position of the safety pin (1), the head (2) thereof is paired with the side surface of the slide (15), a ball-spring assembly (12,13) cooperates with a positioning slot (7), wherein said flat recess (8) is in a horizontal position parallel to the axis of a firing pin (28), without interfering with a lower notch (29) of said firing pin (28), and said notch (9) of the head (2) of the safety pin (1) is parallel to the guide (26) of a pistol frame (31), and said head (2) does not interfere with a housing (24) resulting from the concave faces of a boss (23) and a notch (25) of the guide (26).

8. The device according to claim 1, wherein, in said second position of the safety pin (1), the head (2) thereof projects from a side surface of an slide (15), a ball-spring assembly (12,13) cooperates with another positioning slot (7), said flat recess (8) is in a vertical position perpendicular to the axis of the firing pin (28), thus interfering with a lower notch (29) of said firing pin said (28), and said notch (9) of the head (2) of the safety pin (1) is perpendicular to a guide (26) of a pistol frame (31), and thus said head (2) interferes with a housing (24) resulting from the concave faces of a boss (23) and a notch (25) of the guide (26).

9. The device according to claim 1, wherein the safety pin (1) switches from said first position to said second position, and vice versa, as it is rotated 90° by using a key (32).

10. The device according to claim 7, wherein the safety pin (1) switches from said first position to said second position, and vice versa, as it is rotated 90° by using a key (32).

11. The device according to claim 8, wherein the safety pin (1) switches from said first position to said second position, and vice versa, as it is rotated 90° by using a key (32).

* * * * *